US006205617B1

(12) United States Patent
Held et al.

(10) Patent No.: US 6,205,617 B1
(45) Date of Patent: Mar. 27, 2001

(54) HINGE

(75) Inventors: Wolfgang Held, Hard; Günter Lenz, Höchst, both of (AT)

(73) Assignee: Julius Blum Gesellschaft m.b.H., Höchst (AU)

( * ) Notice: Subject to any disclaimer, the term of this patent is extended or adjusted under 35 U.S.C. 154(b) by 0 days.

(21) Appl. No.: 09/372,097

(22) Filed: Aug. 11, 1999

(30) Foreign Application Priority Data

Aug. 17, 1998 (AT) ..... 1399/98

(51) Int. Cl.[7] ..... E05D 7/06

(52) U.S. Cl. ..... 16/246; 16/236; 16/237; 16/238; 16/239; 16/240; 411/402

(58) Field of Search ..... 16/246, 236, 237, 16/238, 339, 240, 245; 411/402, 410, 919

(56) References Cited

U.S. PATENT DOCUMENTS 4,517,706 * 5/1985 Lautenschlager ..... 16/238
4,799,289 * 1/1989 Grass ..... 16/236
5,056,190 * 10/1991 Rock et al. ..... 16/240
5,379,487 1/1995 Bowers .
5,934,853 * 8/1999 Junkers ..... 411/402

FOREIGN PATENT DOCUMENTS 25 23 347 5/1976 (DE) .
0168731 1/1986 (EP) .
86/02402 4/1986 (WO) .

* cited by examiner

*Primary Examiner*—Anthony Knight
*Assistant Examiner*—Enoch E Peavey
(74) *Attorney, Agent, or Firm*—Wenderoth, Lind & Ponack, L.L.P.

(57) ABSTRACT

A hinge with an adjusting device for adjusting the position of an elongated hinge arm which is mounted on a base plate and is connected to a hinge cup by means of articulated hinge links. The base plate has a mounting plane for abutting a furniture side wall in the mounted position and the position of the hinge arm is adjustable by the adjusting device in a plane perpendicular to said mounting plane. The adjusting device comprises two screws spaced from each other in the longitudinal direction of the hinge arm and being perpendicular to the mounting plane of the base plate. The screws are coupled to each other so that rotation of one screw will result in rotation of the other screw.

16 Claims, 5 Drawing Sheets

HINGE

BACKGROUND OF THE INVENTION

The invention relates to a hinge with an adjusting device for adjusting the position of an elongated hinge arm which is mounted on a base plate and is connected to another hinge part, for example a hinge cup by means of articulated hinge links or the like, the base plate having a mounting plate for abutting a furniture side wall in the mounted position and the hinge arm being adjustable by said adjusting device in a plane perpendicular to said mounting plane.

A hinge of this type is known from WO 86/02402.

When mounting such a hinge it is sufficient to hang the hinge arm, which is provided with the intermediate piece, on to the mounting plate and to tilt the hinge arm and the intermediate piece towards the side wall of the piece of furniture, whereby the intermediate part is automatically arrested on the mounting plate. Mounting and demounting of the hinge arm on the mounting plate can be done manually without use of a tool. However, for adjusting the position of the hinge arm with respect to the mounting plate a screw driver is needed.

The hinge arm is held on the intermediate piece by means of two screws. One of the screws has a head which is anchored in the intermediate piece and a threaded shaft which is held in the female thread of the hinge arm. By means of this screw an adjustment of the hinge arm in the direction perpendicular to the side of a piece of furniture can be achieved.

The second screw is a clamping screw which clamps the hinge arm to the intermediate piece and which projects through an elongated hole in the hinge arm. A possibility for adjusting the position of the hinge arm in the direction of the depth of the piece of furniture is determined by this elongated hole.

For adjustment of the front end of the hinge arm in a direction perpendicular to the side wall of a piece of furniture first the clamping screw has to be loosened and then the second screw, which is the side adjustment screw is turned. After the side adjustment of the hinge arm is accomplished the clamping screw is tightened again.

A disadvantage with conventional hinges is that when the side adjustment screw is turned not only the position of the front end of the hinge arm in a plane perpendicular to the side wall of the piece of furniture is altered, the hinge arm is also displaced in the direction of the depth of the piece of furniture. Even if this displacement may be only in the range of less than a millimeter it can result in not correct opening and closing of the door.

European patent EP 0 595 045 B1 discloses a hinge whereby guides are provided between the hinge arm and an intermediate piece such that with every pivot movement of the hinge arm relative to the base plate the movement of the hinge arm in the direction of the depth of the piece of furniture is automatically corrected so that in the end, the front and of the hinge arm remains in the same position with respect to the direction of the depth of the piece of furniture.

SUMMARY OF THE INVENTION

It is the object of the present invention to improve a hinge of the aforementioned kind in such a way that an adjustment of the position of the hinge arm with respect to the base plate in a direction perpendicular to furniture side wall will not result in displacement of the hinge arm in a direction of the depth of the piece of furniture.

According to the invention this is achieved in that the adjusting device comprises at least two screws spaced from each other in the longitudinal direction of the hinge arm and being perpendicular to said mounting plane of said base plate, said screws being coupled to each other so that rotation of one screw with result in rotation of the other screw. An exemplary embodiment of the invention provides, that the screws are positively coupled to each other.

A further embodiment of the invention provides that each screw is provided with a gear ring. The screws can be coupled by means of a toothed belt or a toothed wheel which meshes with the gear rings of the two screws.

A further embodiment of the invention provides that the toothed wheel as provided with a driving shaft with a hold for a screw driver. For adjusting the position of the hinge arm in a direction perpendicular to the drawer side wall it is only necessary to turn the driving shaft of the toothed wheel by means of a screw driver.

BRIEF DESCRIPTION OF THE DRAWINGS

The invention will now be described in more detailed by way of example only with reference to the accompanying drawings wherein.

Figure 1:
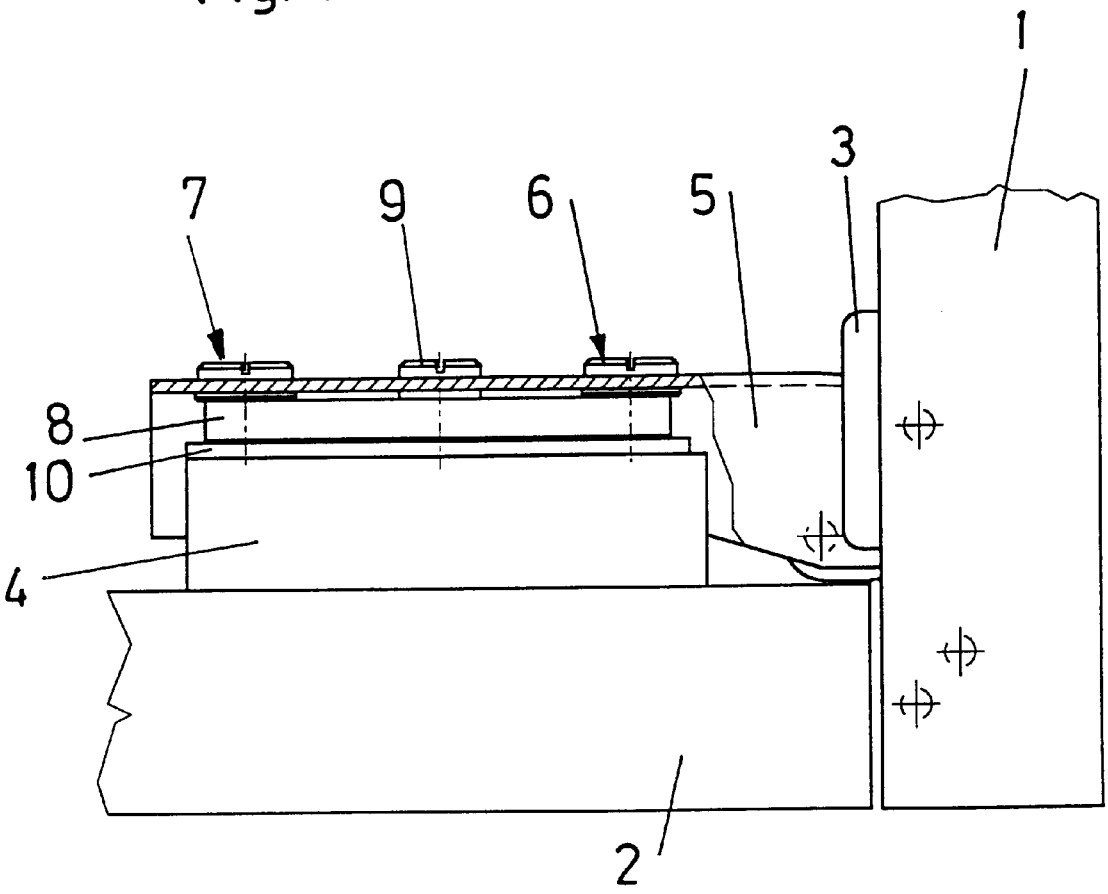
FIG. 1 is a side view of a hinge according the invention mounted on a piece of furniture partially in section.
Figure 2:
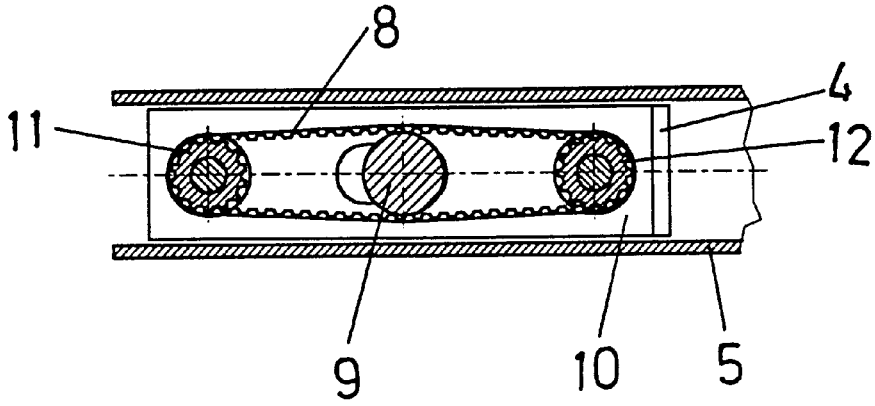
FIG. 2 is a longitudinal section through a hinge arm and a base plate in a plane parallel to the furniture side wall.

The hinge according to the invention is provided with a hinge arm 5 which is mounted on a base plate 4 by means of an intermediate piece 10, 24. The base plate 4 is mounted on a furniture side wall 2 by means of screws and abuts said furniture side wall 2 with a mounting plane. Instead of the hinge arm 5 being mounted on the base plate 4 by means of one intermediate piece 10, 24 a further intermediate piece could be provided as shown for example in the international application WO86/02402. The further intermediate piece being coupled to the base plate by means of a snap-in mechanism.

The hinge arm 5 is connected to a hinge cup 3 by means of hinge links which are not shown in the drawings. The hinge cup 3 is mounted in a bore of a door 1.

Figure 5:
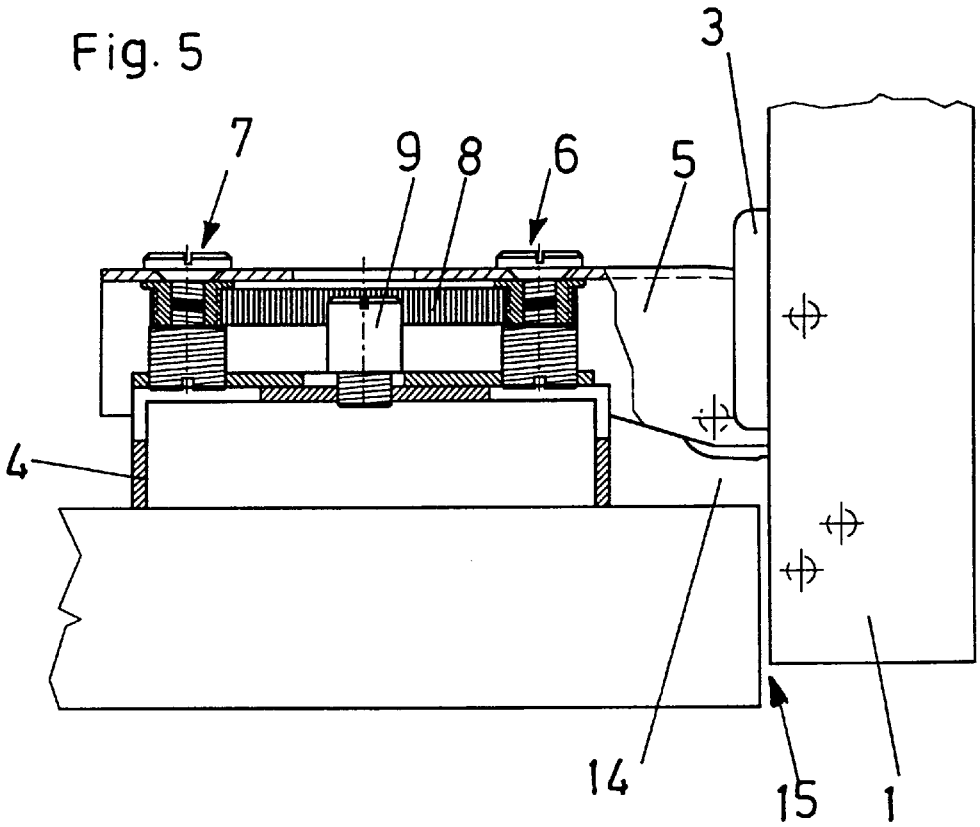
FIG. 5 is a longitudinal section through the hinge arm and the base plate in a plane perpendicular to the furniture side wall and a closed door, whereby the maximal distance between the hinge arm and the furniture side wall and a small distance between the door and the front face of the furniture side wall is shown.
Figure 6:
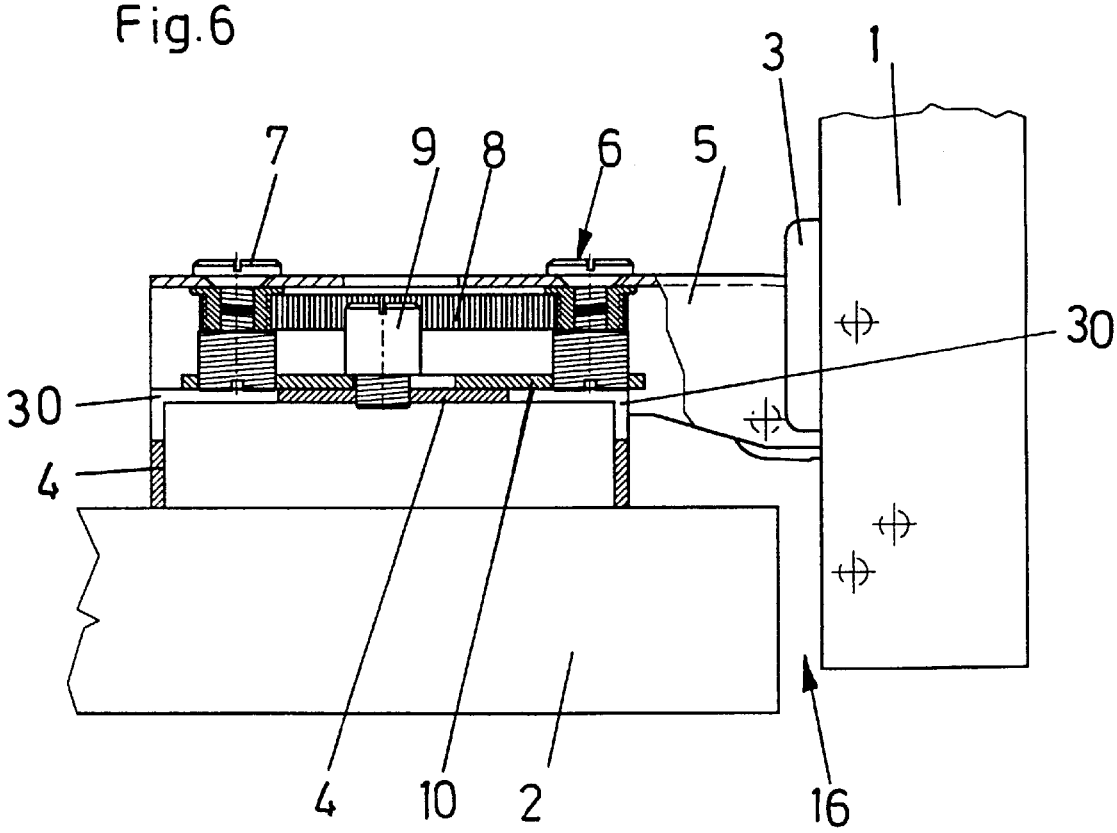
FIG. 6 shows the same sectional view as FIG. 5 whereby the maximal distance of the hinge arm from the furniture side wall and the maximal distance of the door from the front face of the furniture side wall is shown.
Figure 7:
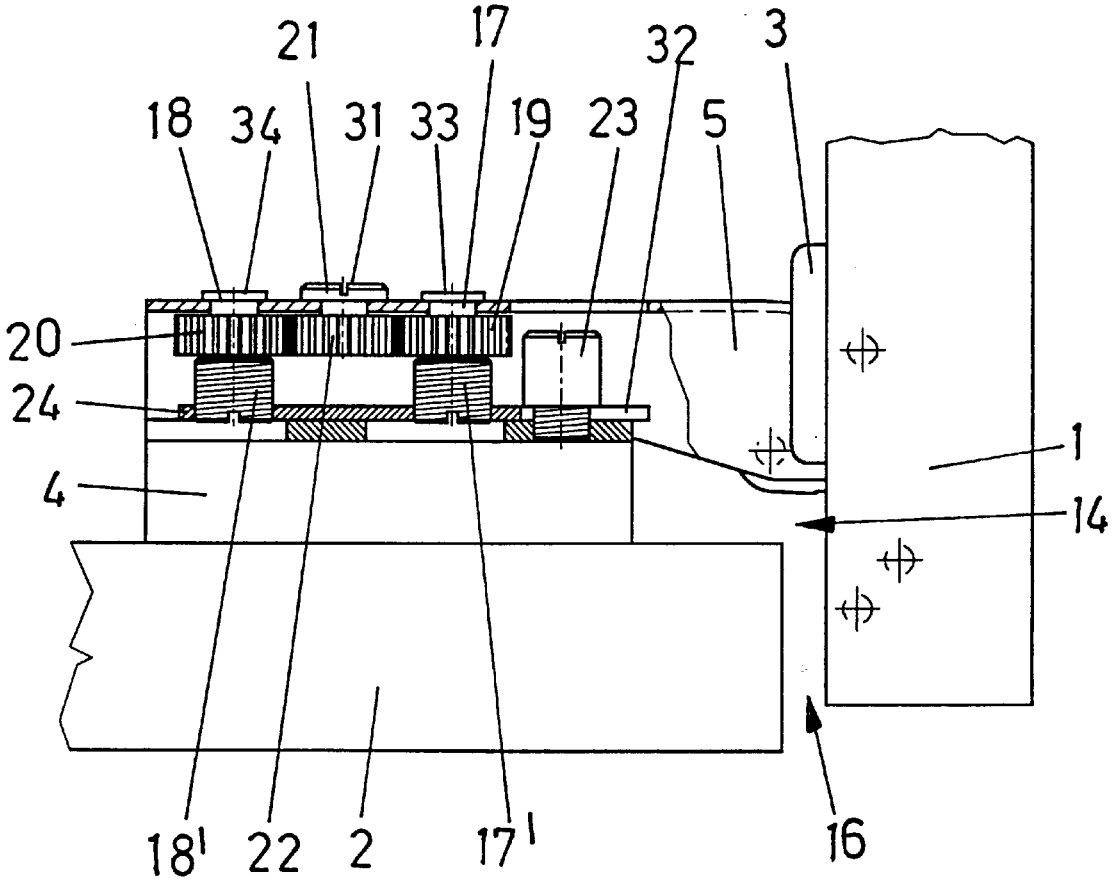
FIG. 7 is a longitudinal section through a hinge arm and a base plate according to a further embodiment of the invention whereby the hinge arm is at a maximal distance from the furniture side wall and the door is at the maximal distance from the front face of the furniture side wall, FIG. 8 a section as shown in FIG. 7, whereby the hinge arm is at its minimal distance from the furniture side wall and the door at its minimal distance from the front face of the furniture side wall and FIG. 9 a section through the hinge arm parallel to the furniture side wall.
Figure 8:
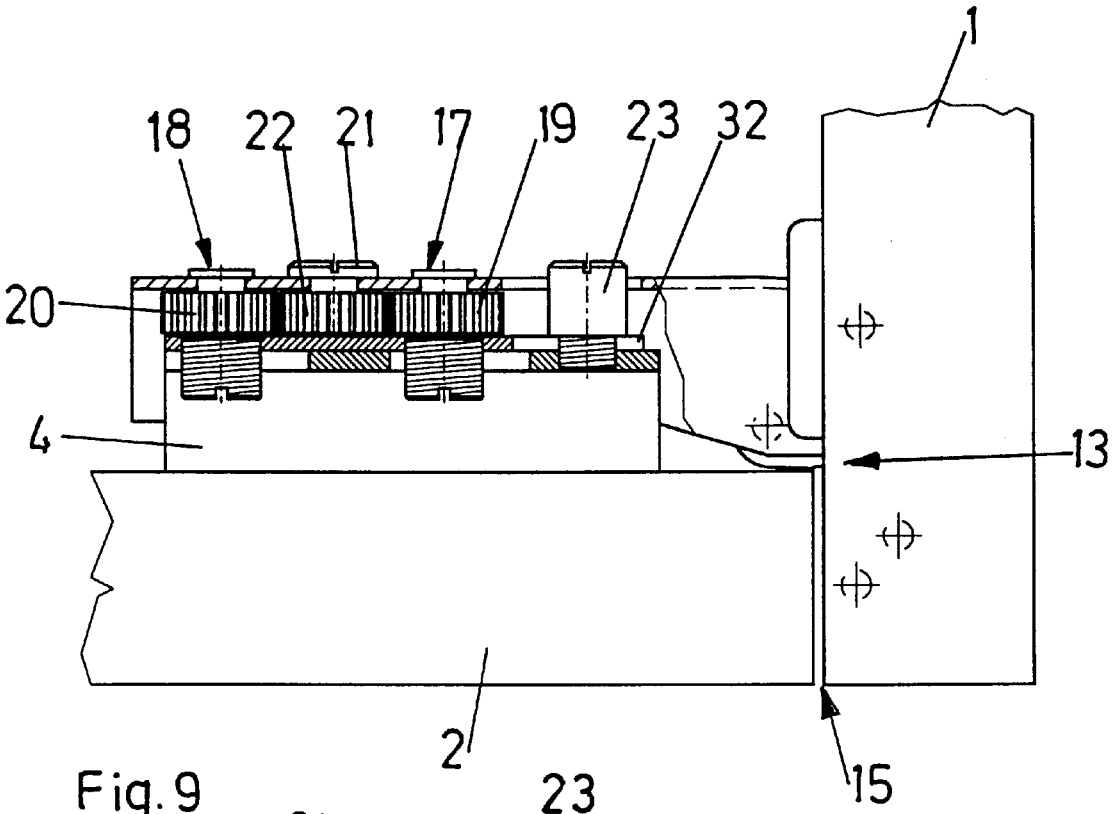
Figure 9:
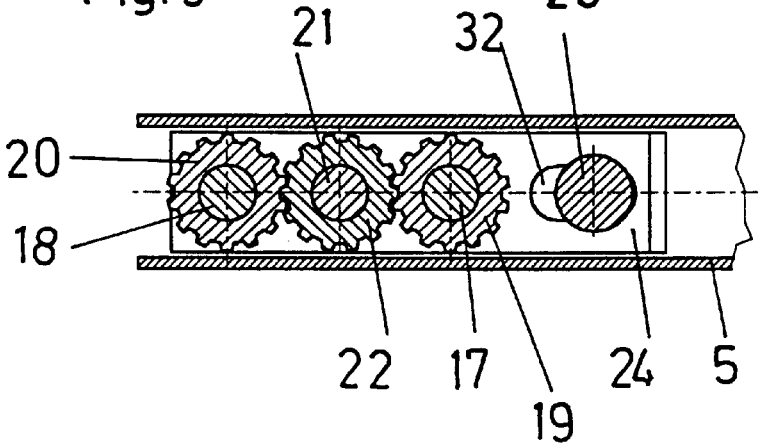

In the embodiment of FIGS. 1 to 6 the intermediate piece 10 is clamped to the mounting plate 4 by means of a clamping screw 9 which protrudes through an elongated slot 25 in the intermediate piece 10 and is held in a female thread in the base plate 4. In the embodiment of FIGS. 7 to 9 an intermediate piece 24 and a clamping screw 23 are provided.

If the clamping screw 9, 23 is loosen the intermediate piece 10, 24 together with the hinge arm 5 can slide on the base plate 4 in the direction of the depth of the piece of furniture.

Lateral adjustment of the hinge arm is achieved by turning the screws 6, 7, 17, 18. The screws 6, 7, 17, 18 are held with their screw threads 6', 7', 17', 18' in corresponding female threads in the intermediate pieces 10 and 24.

In the embodiment according to FIGS. 1 to 6 the screws 6 and 7 are provided with shafts 28, 29 with a reduced diameter annexed to the screw heads 26, 27. The screw heads 26, 27 rest on the outside of the middle web of the hinge arm 6.

The portions of the shafts with reduced diameters carry gear rings 11, 12. A toothed belt 8 is held on the gear rings 11, 12. By means of the toothed belt 8 or the gear rings 11, 12 the screws 6, 7 are turned synchronous. That means if one of the screws 6, 7 is turned by means of a screw drivers the second screw 6, 7 is turned in the same degree so that the hinge arm 5 will be moved parallel to the furniture side wall 2 either away from the furniture side wall 2 or towards the furniture side wall 2.

The screws 6, 7 protrude through elongated slots in the base plate 4.

The clamping screw 9 is situated between the two screws 6 and 7 and within the toothed belt 8. Hereby the adjustment of the hinge arm 5 in the direction of the depth of the piece of furniture is not hindered by the screws 6 and 7 and the toothed belt 8 and lateral adjustment of the hinge arm 5 takes place independently of the clamping screw 9.

Figure 3:
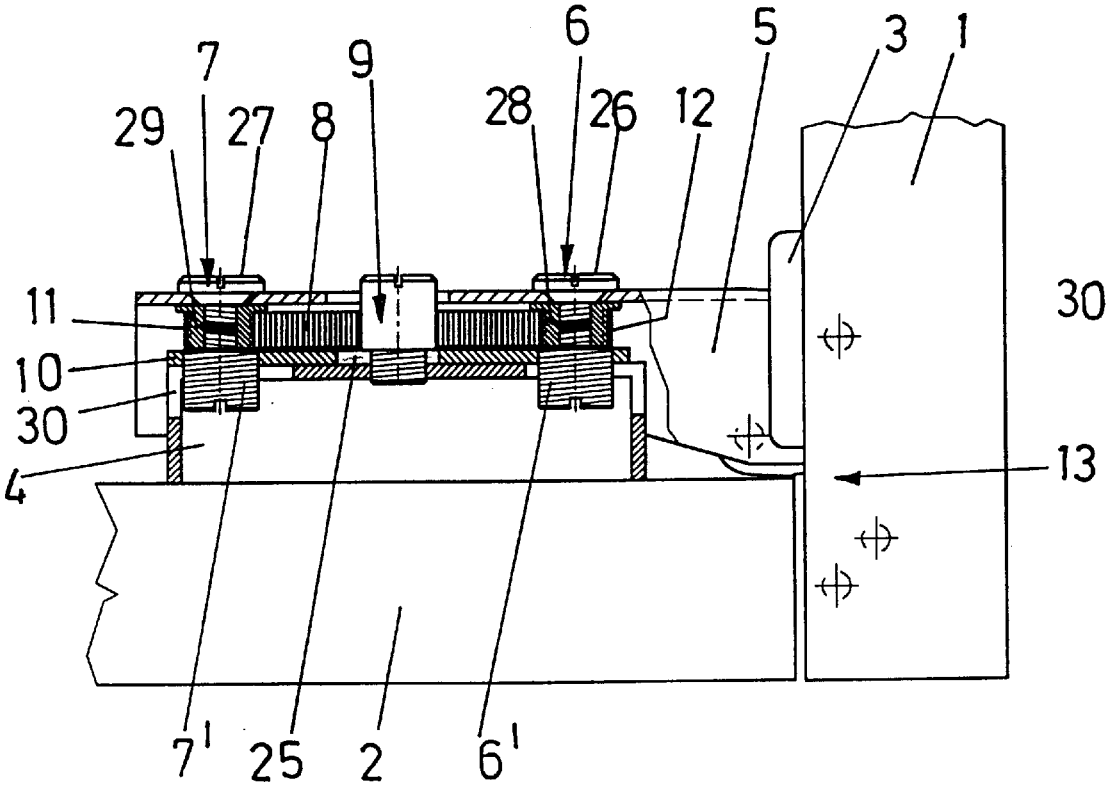
FIG. 3 is a longitudinal section to a hinge arm and a base plate in a plane perpendicular to the furniture side wall and the closed door, whereby the hinge arm is shown in its position nearest to the furniture side wall.
Figure 4:
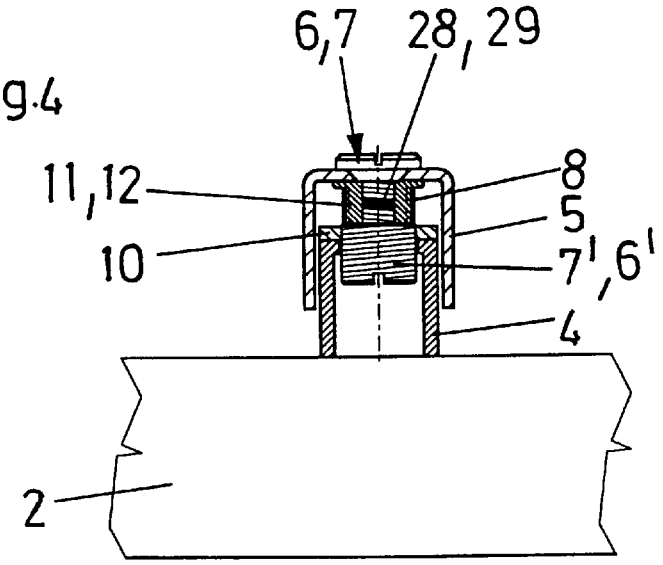
FIG. 4 is cross section of the hinge arm and the base plate.

In FIGS. 3, 4, 5 the limits of the adjustment range for the door 1 in lateral direction and in the direction in the depth of the piece of furniture are shown. In FIG. 3 the reference number 13 denominates the smallest distance between the hinge arm 5 and the furniture side wall 2.

FIG. 5 shows the maximal distance between the hinge arm 5 and the furniture side wall 2. This distance is indicated by the reference number 14.

The reference number 15 shows the smallest possible distance between the door 1 and the front face of the furniture side wall 2. In FIG. 6 the reference number 16 shows the maximal distance between the door 1 and the front face of the furniture side wall 2.

In the embodiment of FIGS. 7 to 9 the gear rings 19, 20 of the screws 17, 18 are connected by means of a gear ring 22. The gear ring 22 is mounted on the hinge arm 5 by means of a driving shaft 21.

If the gear ring 22 is turned by means of a screw driver engaging in the hold 31 on the driving shaft 21 the screws 17, 18 are turned to the same extend so that the hinge arm 5 is parallelly moved either towards the furniture side wall 2 or away from furniture side wall 2.

In this embodiment the clamping screw 23 is situated between the screw 17 and the end of the base plate 4 which is nearest to the door 1. The clamping screw 23 is held in a female thread of the base plate 4 and protrudes through a slot 32 in the intermediate piece 24. The slot 32 is open towards the door 1.

In FIGS. 7 to 9 the minimal and maximal distances between the door 1 and the furniture side wall 2 as well as between the hinge arm 5 and the furniture side wall 2 are indicated by the reference numbers 13, 14, 15, 16.

Again the screws 17, 18 are provided with shaft portions with reduced diameter, the gear rings 19, 20 being situated on these portions. The heads 33, 34 of the screws 17, 18 abut the middle web of the hinge arm 5.

What is claimed is:

1. A hinge with an adjusting device for adjusting the position of an elongated hinge arm which is mounted on a base plate and is connected to another hinge part, the base plate having a mounting plane for abutting a furniture side wall in the mounted position and the hinge arm being adjustable by said adjusting device in a plane perpendicular to said mounting plane, wherein the adjusting device comprises at least two screws spaced from each other in the longitudinal direction of the hinge arm and being perpendicular to said mounting plane of said base plate, said screws being coupled to each other so that rotation of one screw will result in rotation of the other screw.

2. A hinge with an adjusting device in claim 1, wherein said screws are positively coupled to each other.

3. A hinge with an adjusting device in claim 1, wherein the screws are rotatably but axially undisplaceably held in the hinge arm.

4. A hinge with an adjusting device in claim 3, wherein said screws engage in female screw threads in the base plate.

5. A hinge with an adjusting device in claim 3, wherein said screws engage in female screw threads in an intermediate piece fastened to said base plate.

6. A hinge with an adjusting device in claim 3, wherein said screws are positively held in said hinge arm.

7. A hinge with an adjusting device in claim 1, wherein each screw is provided with a gear ring.

8. A hinge with an adjusting device in claim 7, wherein each gear ring is situated between a thread of the screw and a head of the screw.

9. A hinge with an adjusting device in claim 8, wherein the hinge arm is held between the head and the gear ring of each screw.

10. A hinge with an adjusting device in claim 7, wherein the gear rings of the screws are coupled by a toothed belt.

11. A hinge with an adjusting device in claim 7, wherein a toothed wheel is provided which meshes with the gear rings of low screws.

12. A hinge with an adjusting device in claim 1, wherein said toothed wheel is provided with a driving shaft with a hold for a screw driver.

13. A hinge with an adjusting device in claim 1, wherein the base plate has U-profile with two side webs which abut a piece of furniture the at least two screws protruding into said U-profile.

14. A hinge with an adjusting device in claim 1, wherein said at least two screws are screwed into female threads of an intermediate piece.

15. A hinge with an adjusting device in claim 5, wherein said intermediate piece is clamped to the base plate by means of a clamping screw.

16. A hinge with an adjusting device in claim 1, wherein said intermediate piece is clamped to a further intermediate piece by means of a clamping screw, said further intermediate piece being mounted on said base plate.

* * * * *